US006247585B1

(12) United States Patent
Holley, Jr.

(10) Patent No.: US 6,247,585 B1
(45) Date of Patent: Jun. 19, 2001

(54) BASKET-STYLE CARRIER HAVING CENTER CELL PARTITIONING TABS

(75) Inventor: John M. Holley, Jr., Lawrenceville, GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/387,925

(22) Filed: Sep. 1, 1999

(51) Int. Cl.[7] ..... B65D 75/00
(52) U.S. Cl. ..... 206/173; 206/187; 206/188
(58) Field of Search ..... 206/139, 186, 206/187–188, 173–175, 193

(56) References Cited

U.S. PATENT DOCUMENTS

| | | | | |
|---|---|---|---|---|
| 2,702,144 | * | 2/1955 | Forrer . | |
| 3,194,478 | * | 7/1965 | Weiss . | |
| 3,669,306 | * | 6/1972 | Forrer | 220/113 |
| 4,000,813 | * | 1/1977 | Stout | 206/187 |
| 4,153,158 | * | 5/1979 | Graser et al. | 206/173 |
| 4,319,682 | * | 3/1982 | Wright et al. | 206/180 |
| 4,450,956 | * | 5/1984 | Wood | 206/186 |
| 4,770,294 | * | 9/1988 | Graser | 206/180 |
| 5,029,698 | * | 7/1991 | Stout | 206/188 |
| 5,884,756 | * | 3/1999 | Holley, Jr. et al. | 206/144 |

FOREIGN PATENT DOCUMENTS

2573726 * 5/1986 (FR) .

* cited by examiner

*Primary Examiner*—David T. Fidei
(74) *Attorney, Agent, or Firm*—Tsugihiko Suzuki

(57) ABSTRACT

A carrier for a plurality of articles arranged in at least two rows, includes substantially parallel first and second side walls, substantially parallel first and second end walls interconnecting the side walls, and a medial partitioning structure extending between and connected to the first and second end walls. The medial partitioning structure is disposed between and substantially parallel to the first and second side walls and includes first and second longitudinal partition panels disposed at least in part in face-to-face contacting relationship. The carrier further includes first and second transverse partition panels formed from the first and second longitudinal partition panels respectively. The first transverse partition panel is foldably connected to the first longitudinal partition panel and extends to the first side wall. The second transverse partition panel is foldably connected to the second longitudinal partition panel and extends to the second side wall. The medial partitioning structure further includes first and second partitioning tabs formed respectively from the first and second transverse partition panels and disposed in a plane of the medial partitioning structure. The tabs are configured and positioned such that the outline of the first tab is offset at least in part from the outline of the second tab.

17 Claims, 5 Drawing Sheets

BASKET-STYLE CARRIER HAVING CENTER CELL PARTITIONING TABS

BACKGROUND OF THE INVENTION

The present invention relates generally to paperboard carriers for use in packaging articles such as beverage bottles, and more particularly to a basket-style carrier in which the articles are arranged in two or more rows and which has partitioning tabs between the center cells.

One traditional paperboard carrier for beverage bottles is the basket-style carrier. An example of such a carrier is shown in U.S. Pat. No. 5,029,698. The carrier include side, end and bottom walls, and is typically used with bottles grouped in two rows. Located between the two rows is a medial partitioning structure which interconnects the end walls and which is formed of two or more overlapping longitudinal partition panels. The medial partitioning structure is connected at its upper end to an upright handle structure by which the basket carrier may be carried. The carrier also includes transverse partition panels extending between each side wall and the medial partitioning structure to define individual cells into which bottles may be placed.

The transverse partition panels, typically, are cut or struck from the longitudinal partition panels, whereupon an opening may be defined in the medial partitioning structure at a location, for example, between the center cells of a six-cell carrier. The opening in the medial partitioning structure is often so large that the structure fails to maintain enough material for providing a substantial partition between the two rows of bottles. This could cause the bottles in the two rows to collide each other while they are drop-loaded into the carrier. Bottle collision could result in bottle breakage when the bottles are made of glass. For this reason, it is advantageous to close the opening, if possible, to prevent bottles from colliding each other.

One way in which the opening in the medial partitioning structure can be at least partially closed is to cut tabs out of the transverse partition panels and to retain the tabs unfolded with respect to the medial partitioning structure. An example of such an approach can be seen in U.S. Pat. No. 2,702,144. One disadvantage of this approach, however, is a relatively large opening area that would remain unoccupied if the partitioning tabs were used in the carrier of the type such as shown in U.S. Pat. No. 5,029,698 where each longitudinal partition panel provides two or more transverse partition panels. In the arrangement where two or more transverse partition panels are cut from each longitudinal partition panel, it is likely that only one of the transverse partition panels can afford a partitioning tab. It is unlikely that such a tab is adequate to effectively prevent bottle collision.

What is needed, therefore, is an improved basket-style carrier that protects glass articles from breakage during the article loading process. Such a carrier should have partitioning means that can considerably reduce the substantial size of the opening in the medial partitioning structure while requiring a minimum amount of material for forming the carrier.

SUMMARY OF THE INVENTION

In meeting the foregoing needs, the present invention provides a carrier for a plurality of articles arranged in at least two rows. The carrier includes substantially parallel first and second side walls, substantially parallel first and second end walls interconnecting the side walls, and a medial partitioning structure extending between and connected to the first and second end walls. The medial partitioning structure is disposed between and substantially parallel to the first and second side walls and includes first and second longitudinal partition panels disposed at least in part in face-to-face contacting relationship. The carrier further includes first and second transverse partition panels formed from the first and second longitudinal partition panels respectively. The first transverse partition panel is foldably connected to the first longitudinal partition panel and extends to the first side wall. The second transverse partition panel is foldably connected to the second longitudinal partition panel and extends to the second side wall. The medial partitioning structure further includes first and second partition tabs formed respectively from the first and second transverse partition panels and remaining unfolded to lie in a plane of the medial partitioning structure. The first and second tabs are configured and positioned such that the outline of the first tab is offset at least in part from the outline of the second tab.

An opening is defined in the medial partitioning structure as a result of forming the transverse partition panels from the longitudinal partition panels. The partitioning tabs reduce the substantial size of the opening which would otherwise be too large for the medial partitioning structure to prevent glass articles on the opposite sides thereof from colliding each other. The tabs of offset outlines, at least in part, cover or occupy different areas of the opening so that the tab material is efficiently utilized to minimize the substantial size or unoccupied area of the opening. The tabs of offset outlines are also useful to minimize the size of the aperture that is defined in each transverse partition panel by forming the tabs out of the transverse partition panels. This is because the tabs of offset outlines allow each tab to be small enough to cover only a part of the entire covered/occupied area of the opening.

The tabs may be disposed in overlapping relationship to cooperate with each other to form a composite partitioning means having an adequate thickness to serve as a cushion between two glass articles. In this case, the overlapping portions of the tabs, of course, cover the same area of the opening and only respective non-overlapping portions of the tabs occupy different areas of the opening.

In a preferred embodiment, the outlines of the tabs may be different from each other. For example, each tab may have a serrated free end edge defining a plurality of teeth such that the teeth of the first tab are arranged in staggered relationship with the teeth of the second tab.

In an alternative embodiment, each tab may be non-symmetrical in shape, and the tabs may be disposed in different orientations such as in opposite orientations. The non-symmetrical shape may be such that the dimension of the respective tab along the length of the medial partitioning structure is greater at one of its upper and lower portions than at the other. Alternatively, the symmetrical shape may be such that the free end edge of the first tab opposed to its base can be inclined to that of the second tab. The opposite orientation may be such that the first tab is disposed in a certain orientation while the second tab is in a different orientation that could be taken by the first tab if the first tab were rotated 180 degrees about a certain axis that lies in the plain of the first tab.

In another preferred embodiment, each longitudinal partition panel provides two or more transverse partition panels formed therefrom, and each tab is formed from one of the transverse partition panels formed from the respective longitudinal partition panel.

Other advantages and objects of the present invention will be apparent from the following description, the accompanying drawings, and the appended claims.

DETAILED DESCRIPTION OF THE PREFERRED EMBODIMENTS

Figure 1:
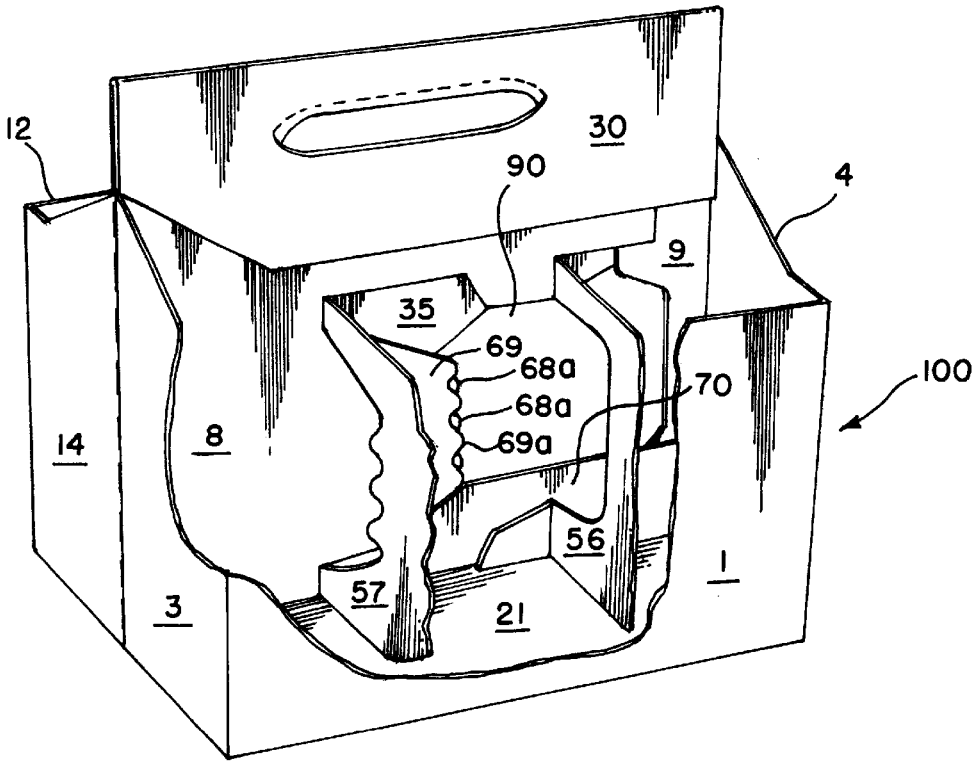
FIG. 1 is a perspective view, partially cut away, of a carrier in accordance with a preferred embodiment of the invention, showing the medial and transverse partitioning structures within the erected carrier.

Throughout the drawings, the same reference numerals are used to denote the same features. Referring to FIG. 1, the present invention provides a basket-style article carrier 100 for carrying articles such as beverage bottles. While the carrier 100 is described herein generally in connection with the carrying of beverage bottles made of glass, it will be recognized that the carrier is suitable for the carrying of other products such as non-beverage products packaged in glass bottles, beverage and non-beverage products packaged in non-bottle glass containers, other liquid and non-liquid products in glass containers, and glass products such as drinking glasses and glass containers.

Figure 2:
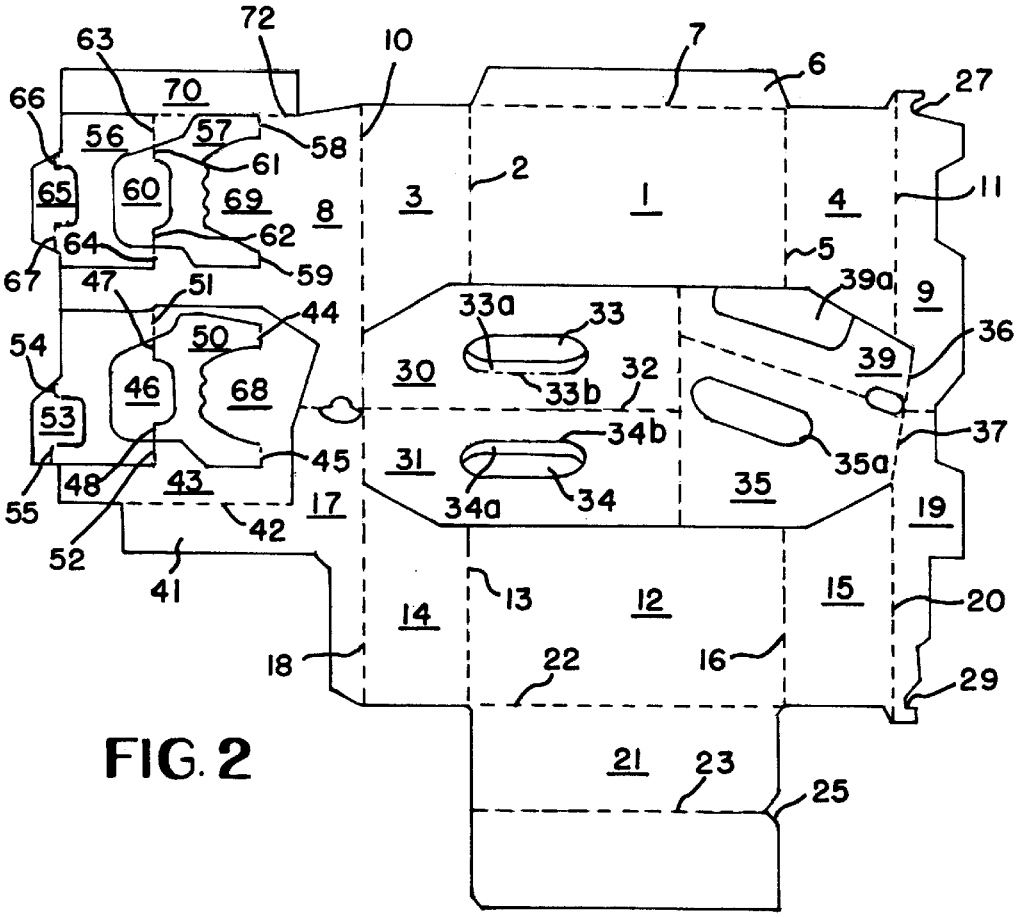
FIG. 2 is a plan view of a blank from which the carrier of FIG. 1 may be formed.

FIG. 2 illustrates the carrier 100 in blank form. The blank includes a side wall panel 1 to an end edge 2 of which an end wall panel 3 is foldably joined. An end wall panel 4 is foldably joined to the opposite end edge 5 of the side wall panel 1 while a glue flap 6 is foldably joined to the bottom edge of the side wall panel 1 along a fold line 7. Riser panels 8 and 9 are foldably joined to the end wall panels 3 and 4 along fold lines 10 and 11, respectively.

On the opposite side of the carrier blank, a side wall panel 12 is foldably joined along an end edge 13 thereof to an end wall panel 14 and at the other end of the carrier, an end wall 15 is foldably joined to the side wall panel 12 along a fold line 16. A riser panel 17 is foldably joined to the end wall panel 14 along a fold line 18 whereas a riser panel 19 is foldably joined to the end wall panel 15 along a fold line 20. A bottom wall panel 21 is foldably joined along a fold line 22 to the bottom edge of the side wall panel 12 and is provided with a medial fold line 23. A notch 25 is formed at one of the ends of the fold line 23 and cooperates in known manner with notches 27 and 29 formed in the riser panels 9 and 19.

The handle structure of the carrier comprises a pair of full length outer handle panels 30 and 31 connected together along a medial fold line 32. The handle panel 30 is foldably joined to the riser panel 8 along a fold line 10 while the handle panel 31 is foldably joined to the riser panel 17 along a fold line 18. Hand gripping apertures 33 and 34 are formed in the handle panels 30 and 31, respectively.

A hand cushioning strip 33*a* is struck from the handle panel 30 and is foldably joined to the handle panel 30 along a fold line 33*b*. In like manner, a hand cushioning strip 34*a* is struck from the handle panel 31 and is foldably joined to the handle panel 31 along a fold line 34*b*. The function and beneficial effects of these structures are apparent from the folding and gluing operations performed during assembly of the carrier.

A handle-reinforcing panel 39 is foldably joined to the riser panel 9 along a diagonal fold lines 36 while a handle-reinforcing panel 35 is foldably joined to the riser panel 19 along a diagonal fold lines 37. The reinforcing panels 35 and 39 are foldably joined together along a diagonal fold line 38. The diagonal fold lines 36 and 37 are arranged in alignment with each other. A hand gripping cutout 39*a* is formed in the reinforcing panel 39 while a hand gripping aperture 35*a* is formed in the reinforcing panel 35.

For the purpose of providing a transverse partitioning structure on one side of the erected carrier 100, a longitudinal partition panel 43 is foldably joined along a fold line 42 to a longitudinal strut portion 41 of the riser panel 17. When in the erected carrier 100, the longitudinal partition panel 43 is disposed immediately underneath the handle panels 30 and 31 and, in cooperation with the riser panels 8, 9, 17 and 19, constitutes a medial partitioning structure disposed medially of the carrier. Among the four riser panels, however, the riser panel 8 serves as a second longitudinal partition panel to be partially secured to the first longitudinal partition panel 43 in face-to-face contacting relationship. The transverse partitioning structure comprises a pair of transverse panels 49 and 50 cut or struck from the longitudinal partition panel 43. The transverse panel 50 is foldably joined along a pair of spaced aligned fold lines 44 and 45 to the longitudinal partition panel 43 and is provided with a glue flap 46 which is foldably joined along a pair of spaced aligned fold lines 47 and 48 to the transverse partition panel 50. Thus, with the glue flap 46 secured in flat face contacting relation in an appropriate position to the inner surface of the side wall panel 12, the transverse partition panel 50 is disposed transversely with respect to the carrier 100 and aids in defining a pair of cells on the one side of the carrier.

In like fashion, the transverse partition panel 49 is foldably joined to the longitudinal partition panel 43 along a pair of spaced aligned fold lines 51 and 52 and is provided with a glue flap 53 which is foldably joined to the transverse partition 49 along a pair of spaced aligned fold lines 54 and 55. Thus, with the glue flap 53 affixed in an appropriate position to the inner surface of the side wall panel 12, the transverse partition panel 49 aids in forming a partition between a pair of adjacent cells on the one side of the carrier 100.

The two transverse partition panels 49 and 50, when in the carrier 100, extend transversely between the side wall panel 12 and the medial partitioning structure, and define between the side wall 12 and the medial partitioning structure three cells for receiving glass bottles.

In order to provide another transverse partitioning structure on the other side of the carrier 100, the riser panel 8 is enlarged substantially so as to serve as the aforementioned second longitudinal partition panel. The transverse partitioning structure on the other side of the carrier is disposed between the side wall panel 1 and the medial partitioning structure and comprises a pair of transverse partition panels 56 and 57 that are cut or struck from the second longitudinal partition panel 8. The panel 57 is foldably joined to the longitudinal partition panel 8 along a pair of spaced aligned fold lines 58 and 59 and is provided with a glue flap 60 which is foldably joined to the transverse partition panel 57 along a pair of spaced aligned fold lines 61 and 62. Thus, with the glue flap 60 secured in flat face contacting relation in an appropriate position to the inside surface of the side wall panel 1, the panel 57 is disposed transversely with respect to the carrier 100 and aids in defining a pair of cells on the other side of the carrier.

In like fashion, the transverse partition panel 56 is foldably joined to the longitudinal partition panel 8 along a pair of spaced aligned fold lines 63 and 64 and is provided with a glue flap 65 which is foldably joined to the transverse partition panel 56 along a pair of spaced aligned fold lines 66 and 67. Thus, with the glue flap 65 affixed in an appropriate position to the inside surface of the side wall panel 1, the transverse partition panel 56 aids in forming a partition between a pair of adjacent cells on the other side of the carrier.

The two transverse partition panels 56 and 57, when in the carrier 100, extend transversely between the side wall panel 1 and the medial partitioning structure, and define between the side wall 1 and the medial partitioning structure three cells for receiving glass bottles.

A center cell partitioning means is formed from the transverse partition panels 50 and 57 to be disposed between the respective center cells on the opposite sides of the medial partitioning structure. The center cell partitioning means comprises partitioning tabs 68 and 69 extending into the opening 90 (shown in FIG. 1) which is defined in the medial partitioning structure by cutting or striking the transverse partition panels 50 and 57 respectively from the longitudinal partition panels 43 and 8. The tab 68 is struck from the transverse partition panel 50 and remains unfolded with respect to the longitudinal partition panel 43. The tab 69 is struck from the transverse partition panel 57 and remains unfolded with respect to the longitudinal partition panel 8. These tabs 68 and 69 are designed to be disposed in overlapping relationship when the carrier is assembled and erected.

Each partitioning tab extends from the respective longitudinal partition panel and terminates in a serrated free end edge that defines two or more teeth formed therealong. Each tooth 68*a* of the tab 68 is identical in size and shape to each tooth 69*a* of the tab 69. However, these teeth 68*a* and 69*a* are positioned such that when in the carrier 100, the teeth 68*a* are arranged in nested or staggered relationship with the teeth 69*a* as shown in FIG. 1. In this arrangement, the space between adjacent teeth on either partitioning tab is filled with a tooth on the other tab.

Further, a keel panel 70 is foldably joined along a fold line 72 to a lower part of longitudinal partition panel 8 and to the small tab between fold line 63 and the transverse panel 57. The keel panel 70 is severed by cut lines from the transverse partition panels 56 and 57 as best shown in FIG. 2.

Figure 3:
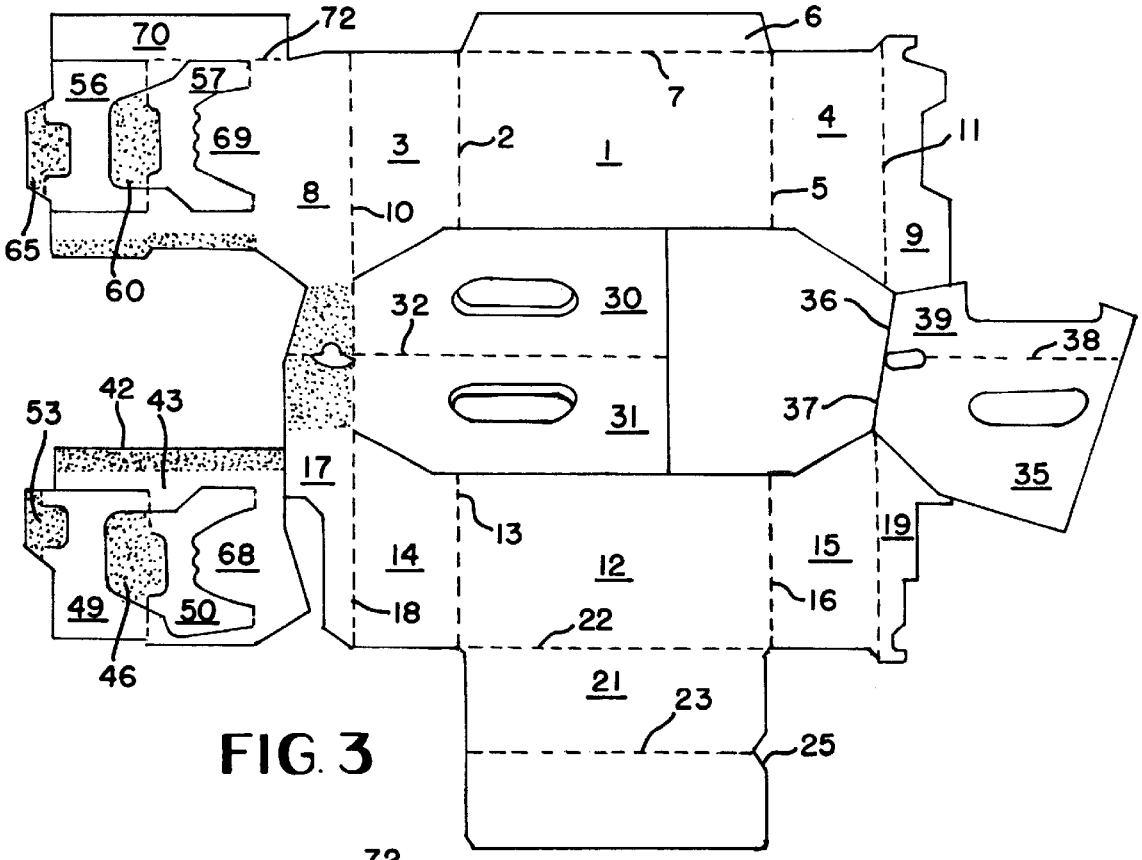
FIGS. 3–8 are series of plan views showing the manner in which the blank of FIG. 2 may be folded to form the completed collapsed carrier.

In order to perform the first folding operation, the combination medial and transverse partitioning structure including the panels 43, 49 and 50 and the associated elements is swung downwardly about the fold line 42 to take the position depicted in FIG. 3. In like fashion, the handle-reinforcing panels 35 and 39 are folded upwardly and outwardly along the fold lines 36 and 37 to occupy the position depicted in FIG. 3.

Figure 4:
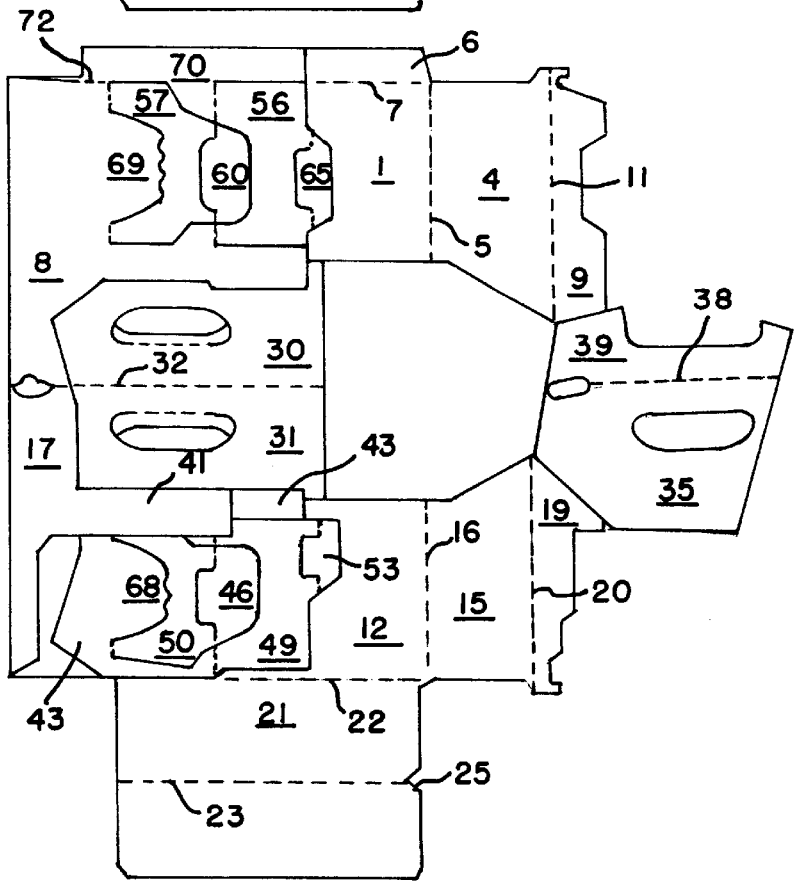

An application of glue is then made to the blank depicted in FIG. 3 as indicated by the stippling in that figure. The next folding operation results in the structure as depicted in FIG. 4 and simply constitutes swinging the riser panels 8 and 17 toward the right along the fold lines 10 and 18, respectively. Such operation causes the combination medial and transverse partitioning structure including the panels 49 and 50 and the associated elements as well as the longitudinal strut portion 41 to be disposed over the side wall panel 12. Simultaneously, the combination medial and transverse partitioning structure including panels 8, 56 and 57 and the associated elements falls into flat face-contacting relation with the side wall panel 1. This folding operation causes the riser panel 8 to adhere to the inner surface of the left hand end of the handle panel 30, and the riser panel 17 to the inner surface of the handle panel 31. In like fashion, the glue flaps 46 and 53 are affixed to the inner surface of the side wall panel 12, and the glue flaps 60 and 65 become adhered to the inner surface of the side wall panel 1. Further as a result of the folding operation, the longitudinal partition panels 8 and 43 are adhered to the handle panels 30 and 31 respectively.

Figure 5:
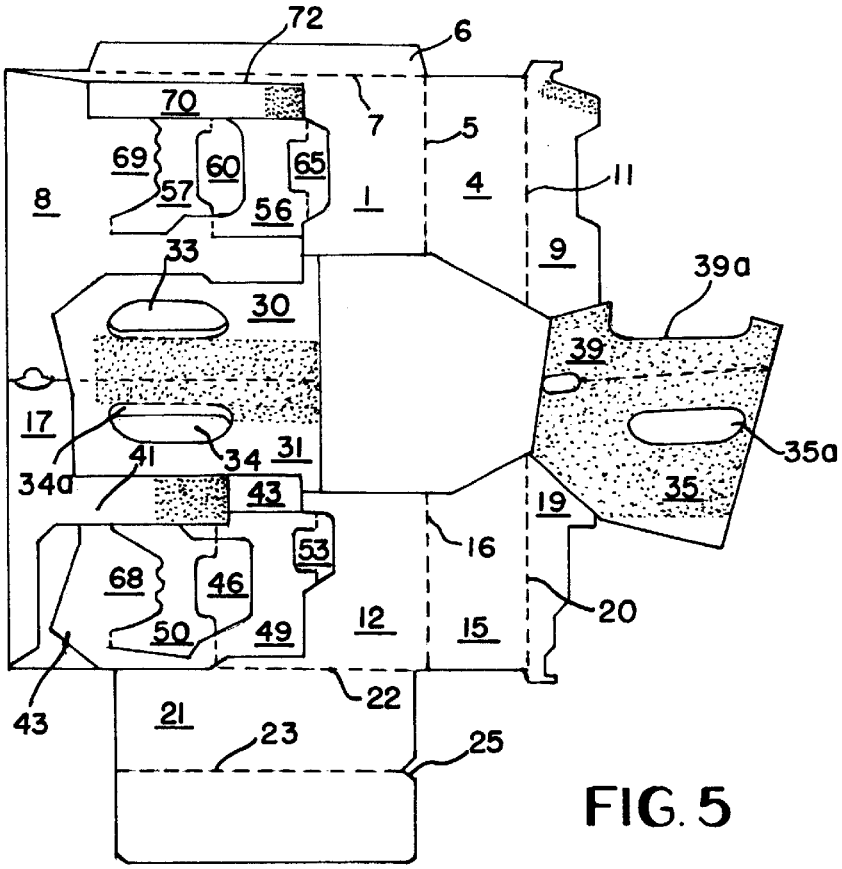

The keel panel 70 is then folded downwardly about the fold line 72 from the position depicted in FIG. 4 to that depicted in FIG. 5. The blank then appears as depicted in FIG. 5.

An application of glue is then made to the blank depicted in FIG. 5 as indicated by the stippling on the right hand end of the keel panel 70, the bottom end of the riser panel 9, the handle-reinforcing panels 35 and 39, the inner surfaces of the handle panels 30 and 31 and of the right hand end of the longitudinal strut portion 41. The end panels 4 and 15 are then lifted and swung toward the left along their respective fold lines 5 and 16 so as to bring the handle-reinforcing panels 35 and 39 into flat face-contacting relation with the inner surface of the handle panels 30 and 31 and so as to cause the stippled surface of the riser panel 9 to adhere to the right hand end of the keel panel 70. Simultaneously, a part of the handle-reinforcing panel 35 is adhered to the longitudinal strut portion 41 as is the upper end of the riser panel 19.

Figure 6:
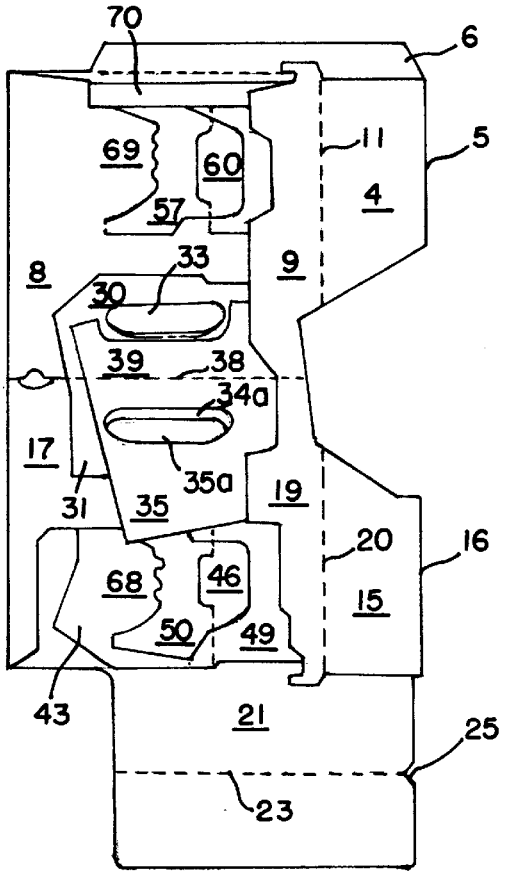

It is apparent that the diagonal disposition of the handle-reinforcing panels 35 and 39 as shown in FIG. 2 results in the structure as shown in FIG. 6 which completely interconnects the riser panels 9 and 19 respectively with the riser panels 8 and 17 and also affords a full hand hole 35*a* which coincides with hand gripping aperture 34 and with the hand cushioning strip 34*a*.

Figure 7:
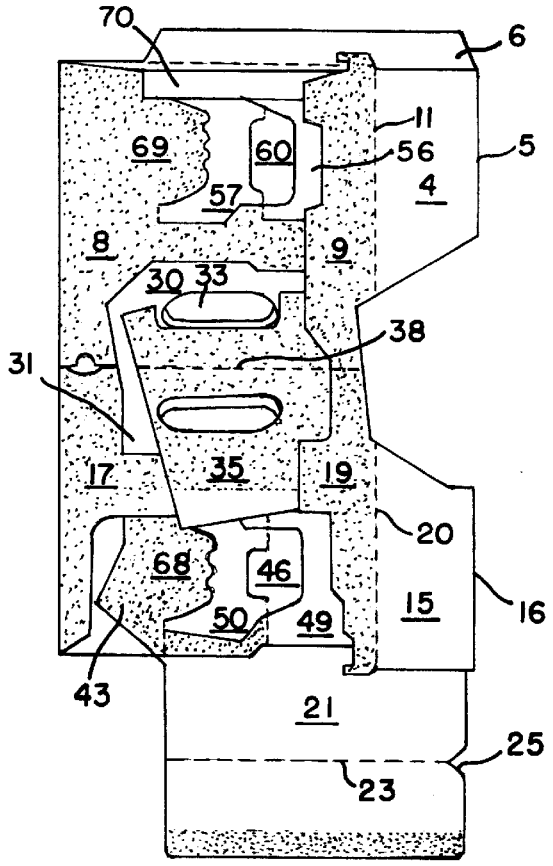

An application of glue is then made to the blank as depicted in FIG. 7 at the places indicated by the stippling and the handle panel 30, the side wall panel 1 and the parts associated therewith are lifted and folded downwardly along the fold lines 32 and 38. This brings the handle-reinforcing panels 35 and 39 into face-to-face contacting relation with each other and causes the riser panels 8 and 9 to adhere respectively to the riser panels 17 and 19. This also causes a part of the riser panel (i.e., longitudinal partition panel) 8 and the tab 69 to adhere respectively to a part of the longitudinal partition panel 43 and the tab 68. The above gluing process causes the medial partitioning structure to be formed for the carrier immediately below the handle structure. After that, the bottom wall panel 21 is folded medially along its fold line 23 by elevating the lower half of the panel 21 upwardly so that the stippled inside surface of the panel 21 is secured to the glue flap 6 in flat face contacting relation. The blank then appears in completed collapsed form as shown in FIG. 8.

Figure 8:
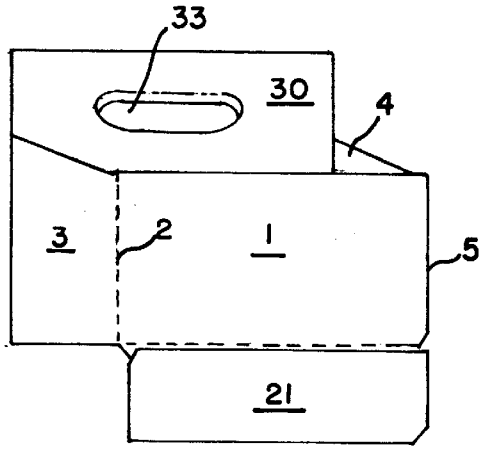

The collapsed carrier shown in FIG. 8 may be erected by moving the side wall panels 1 and 12 longitudinally with respect to the handle panel 30. This erecting method is typical of basket-style carriers of the prior art. By moving the side wall panels 1 and 12, the end wall panels 3, 4, 14 and 15 are moved to the position perpendicular to the medial partitioning structure to form the end walls of the carrier. Such a position of the end walls is shown in FIG. 1 wherein the carrier is illustrated in erected form.

As shown in FIG. 1, the erected carrier 100 includes a pair of parallel side walls 1 and 12 and a pair of end walls, i.e., one being composed of panels 3 and 14 and the other being of panels 4 and 15. These end walls foldably interconnect the side walls 1 and 12 to form a vertical rectangular tubular structure. The carrier also includes the medial partitioning structure. As apparent from the foregoing description, the medial partitioning structure extends between and is foldably connected to the end walls 3 and 14; and 4 and 15 so that it is disposed between the side walls 1 and 12 where it is parallel to the side walls 1 and 12. The bottom wall panel 21 extends and is foldably connected to the lower ends of the side walls 1 and 12. The transverse partition panels 49, 50, 56 and 57 are disposed transversely of the medial partitioning structure to define three cells on either side of the medial partitioning structure. Because the transverse partition panels 49, 50, 56 and 57 are cut from the longitudinal partition panels 43 and 8, an opening 90 is defined in the medial partitioning structure as shown in FIG. 1. If this opening were excessively large, the glass bottles for the center cells would collide each other when loaded into the carrier 100. However, the overlapped tabs 68 and 69 eliminate the chance of such collision by extending into the opening 90 and thereby reducing the substantial size or unoccupied area of the opening 90. The teeth 68*a* and 69*a* in the staggered relationship occupy different areas of the opening 90 as shown in FIG. 1. This tooth arrangement allows the material of the tabs to be efficiently utilized to minimize the substantial size of the opening 90. Stated differently, the staggered tooth arrangement allows a minimum area of the opening 90 to remain unoccupied by the tabs 68 and 69. The tabs 68 and 69 with the serrated end edges are also useful to minimize the chance of collision of two glass bottles that are to be received in the adjacent cells on the opposite sides of the respective transverse partition panels 50 and 57.

Figure 9:
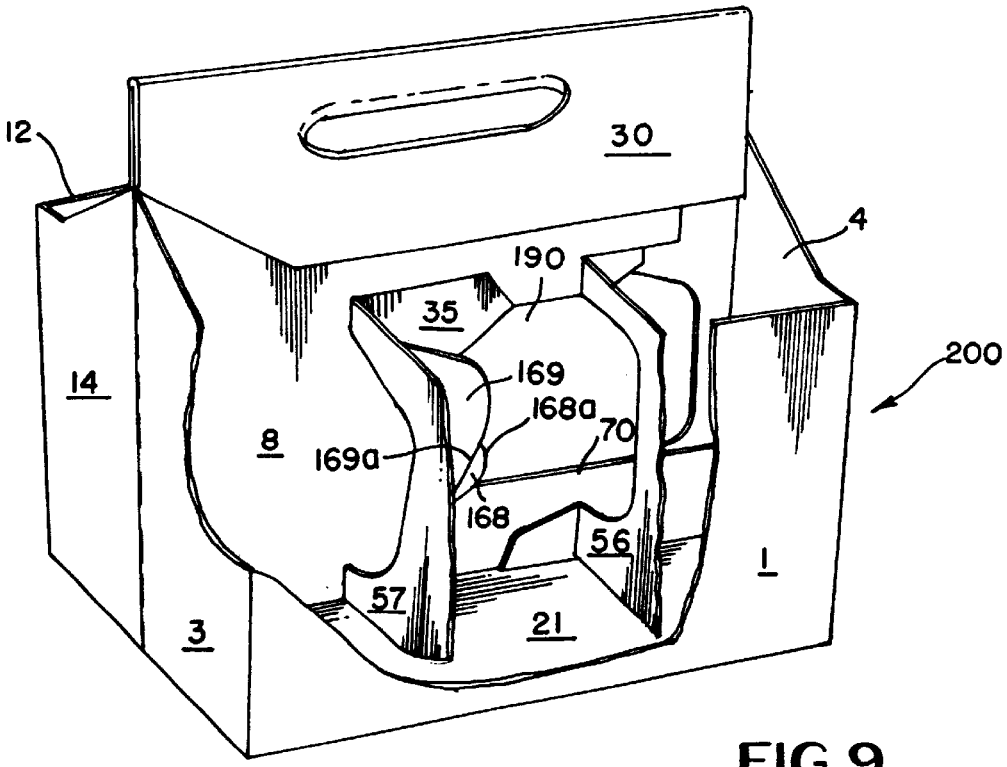
FIG. 9 is a perspective view similar to FIG. 1, showing an erected carrier according to an alternative embodiment of the invention.
Figure 10:
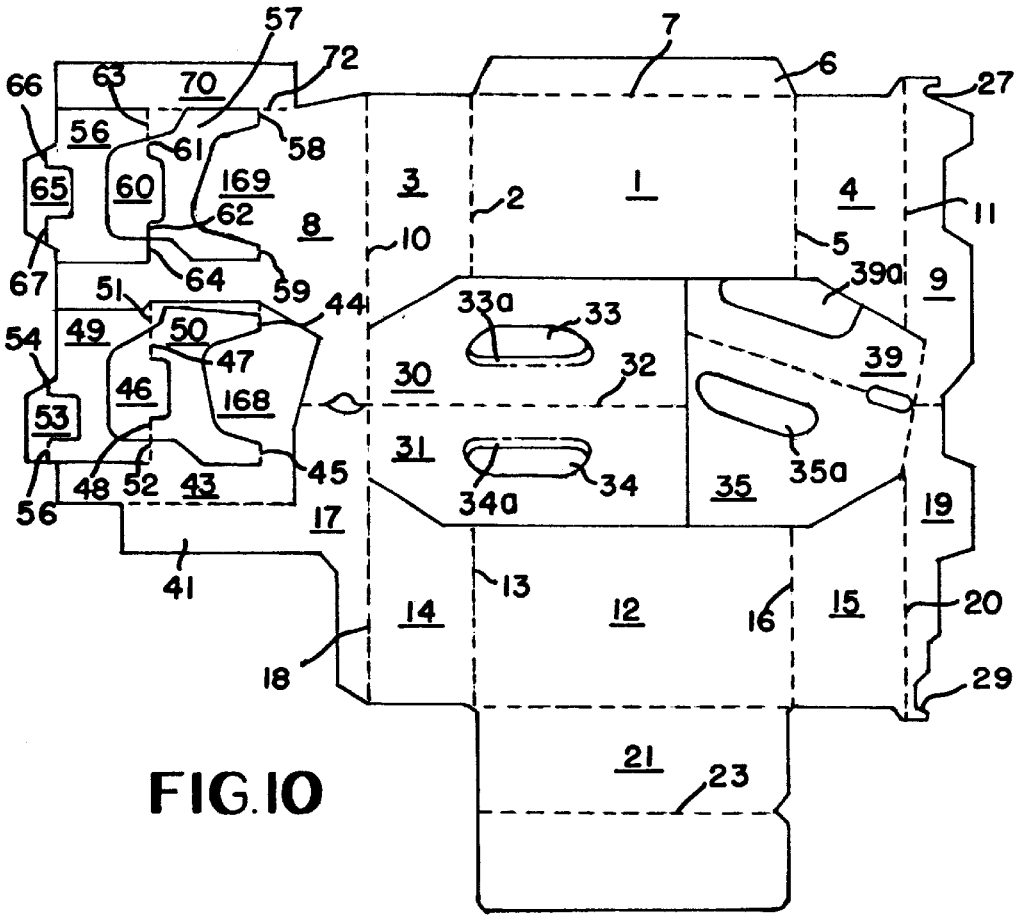
FIG. 10 is a plan view of a blank from which the carrier of FIG. 9 may be formed.

FIGS. 9 and 10 illustrate an alternative embodiment of the invention. The carrier 200 in this embodiment is virtually identical to that in the embodiment of FIGS. 1–8 except for the partitioning tabs 168 and 169. Unlike the embodiment of FIG. 1–8, each partitioning tab in this embodiment is non-symmetrical in shape and does not have the serrated end edge. Instead, each tab has an inclined free end edge at the location opposed to its base joined to the respective longitudinal partition panel. The free end edge 168*a* of the tab 168 is inclined to the vertical such that the size of the tab 168 along the horizontal length of the medial partitioning structure is greater at its lower end portion than at its upper end portion whereas the end edge 169*a* of the tab 169 is inclined such that the length of the tab 169 is greater at its upper end portion than at its lower end portion. In other words, the tabs 168 and 169 are similar to each other in size and shape. However, they are arranged in opposite orientations in the sense that the tab 169 is disposed in the orientation which could be taken by the tab 168 if the tab 168 were rotated 180 degrees about a horizontal axis that lies in the plain of the tab 168. This arrangement allows the lower end portion of the tab 168 and the upper end portion of the tab 169 to occupy different areas of the opening 190 as shown in FIG. 9. This opposite orientation arrangement also allows the material of the tabs 168 and 169 to be efficiently utilized to minimize the substantial size of the opening 190.

It would be recognized that variations may be made to the foregoing embodiments within the scope of the invention. For example, the partitioning tabs in either embodiment may be disposed side by side or with a space therebetween without overlapping. It would be also recognized that the outlines of the tabs 68 and 69 may be completely identical provided that they are disposed offset from each other upon erection of the carrier.

What is claimed is:

1. A carrier for a plurality of articles arranged in at least two rows, comprising:

substantially parallel first and second side walls;

substantially parallel first and second end walls interconnecting said side walls;

a medial partitioning structure extending between and connected to said first and second end walls, said medial partitioning structure being disposed between and substantially parallel to said first and second side walls, said medial partitioning structure comprising first and second longitudinal partition panels disposed at least in part in face-to-face contacting relationship; and first and second transverse partition panels formed from said first and second longitudinal partition panels respectively, said first transverse partition panel being foldably connected to said first longitudinal partition panel and extending to said first side wall, said second transverse partition panel being foldably connected to said second longitudinal partition panel and extending to said second side wall, said first and second transverse partition panels defining an opening in said medial partitioning structure, wherein said medial partitioning structure further comprises first and second partitioning tabs formed respectively from said first and second transverse partition panels, said tabs being disposed in overlapping relationship and lying in a plane of said medial partitioning structure, said tabs extending in a generally identical direction into said opening and terminating in respective free end edges thereof, said free end edges of said tabs being disposed transversely of each other so that at least some portion of said first tab and at least some portion of said second tab occupy different areas of said opening respectively.

2. A carrier for a plurality of articles arranged in at least two rows, comprising:

substantially parallel first and second side walls;

substantially parallel first and second end walls interconnecting said side walls;

a medial partitioning structure extending between and connected to said first and second end walls, said medial partitioning structure being disposed between and substantially parallel to said first and second side walls, said medial partitioning structure comprising first and second longitudinal partition panels disposed at least in part in face-to-face contacting relationship; and first and second transverse partition panels formed from said first and second longitudinal partition panels respectively, said first transverse partition panel being foldably connected to said first longitudinal partition panel and extending to said first side wall, said second transverse partition panel being foldably connected to said second longitudinal partition panel and extending to said second side wall, said first and second transverse partition panels defining an opening in said medial partitioning structure, wherein said medial partitioning structure further comprises first and second partitioning tabs formed respectively from said first and second transverse partition panels, said tabs being disposed in overlapping relationship, projecting into said opening and lying in a plane of said medial partitioning structure, and wherein each of said tabs has a serrated free end edge defining a plurality of teeth, said teeth of said tabs are disposed such that said teeth of said first tab are arranged in staggered relationship with said teeth of said second tab so that said teeth of said first tab and said teeth of said second tab occupy different areas of said opening respectively.

3. The carrier according to claim 2 wherein said each tab is non-symmetrical in shape, and said tabs are disposed in different orientations.

4. The carrier according to claim 3 wherein said tabs are disposed in opposite orientations.

5. The carrier according to claim 4 wherein said each tab has upper and lower portions, said peak of said first tab being located at said lower portion of said first tab, said peak of said second tab being located at said upper portion of said second tab.

6. A carrier for a plurality of articles arranged in at least two rows, comprising:

substantially parallel first and second side walls;

substantially parallel first and second end walls interconnecting said side walls;

a medial partitioning structure extending between and connected to said first and second end walls, said medial partitioning structure being disposed between and substantially parallel to said first and second side walls, said medial partitioning structure comprising first and second longitudinal partition panels disposed at least in part in face-to-face contacting relationship; and first and second transverse partition panels formed from said first and second longitudinal partition panels respectively said first transverse partition panel being foldably connected to said first longitudinal partition panel and extending to said first side wall, said second transverse partition panel being foldable connected to said second longitudinal partition panel and extending to said second side wall, wherein said medial partitioning structure further comprises first and second partitioning tabs formed respectively from said first and second transverse partition panels and disposed in a plane of said medial partitioning structure, said tabs being configured and positioned such that an outline of said first tab is offset at least in part from an outline of said second tab, and wherein each of said longitudinal partition panels provides at least two transverse partition panels formed therefrom, and each of said tabs is formed from one of said at least two transverse partition panels formed from a respective one of said longitudinal partition panels.

7. The carrier according to claim 6 further comprising a bottom wall extending between and connected to respective lower end edges of said first and second side walls.

8. The carrier according to claim 6 further comprising a handle structure disposed above and secured to said medial partitioning structure.

9. A carrier for a plurality of articles arranged in at least two rows, comprising:

substantially parallel first and second side walls;

substantially parallel first and second end walls interconnecting said side walls;

a medial partitioning structure extending between and connected to said first and second end walls, said medial partitioning structure being disposed between and substantially parallel to said first and second side walls, said medial partitioning structure comprising first and second longitudinal partition panels disposed at least in part in face-to-face contacting relationship; and first and second transverse partition panels formed from said first and second longitudinal partition panels respectively, said first transverse partition panel being foldably connected to said first longitudinal partition panel and extending to said first side wall, said second transverse partition panel being foldably connected to said second longitudinal partition panel and extending to said second side wall, said first and second transverse partition panels defining an opening in said medial partitioning structure, wherein said medial partitioning structure further comprises first and second partitioning tabs formed respectively from said first and second transverse partition panels, said tabs being disposed in overlapping relationship and lying in a plane of said medial partitioning structure, said tabs extending in a generally identical direction into said opening and terminating in respective free end edges thereof, each of said tabs having a peak along said free end edge thereof, said peak of said first tab being disposed at a location offset from said peak of said second tab so that said peaks occupy different areas of said opening respectively.

10. The carrier according to claim 9 wherein said tabs extend along the length of said medial partitioning structure to said respective free end edges, and said each tab has a maximum length at a portion thereof including said peak thereof.

11. The carrier according to claim 9 wherein said free end edges of said tabs are disposed transversely of each other.

12. The carrier according to claim 9 wherein said tabs extend along the length of said medial partitioning structure to said respective free end edges, and said free end edge of said each tab is disposed transversely of the length of said medial partitioning structure.

13. The carrier according to claim 5 wherein the size of said first tab along the length of said medial partitioning structure is greater at said lower portion thereof than at said upper portion thereof, and the size of said second tab along the length of said medial partitioning structure is greater at said upper portion thereof than at said lower portion thereof.

14. The carrier according to claim 1 wherein said tabs extend along the length of said medial partitioning structure to said respective free end edges, and said free end edge of each of said tabs is disposed transversely of the length of said medial partitioning structure.

15. The carrier according to claim 14 wherein said each tab has an upper portion and a lower portion, the size of said first tab along the length of said medial partitioning structure is greater at said lower portion thereof than at said upper portion thereof, and the size of said second tab along the length of said medial partitioning structure is greater at said upper portion thereof than at said lower portion thereof, whereby a part of said lower portion of said first tab near said free end edge thereof is offset from a part of said upper portion of said second tab near said free end edge thereof so that said part of said lower portion of said first tab and said part of said upper portion of said second tab occupy said different areas of said opening respectively.

16. The carrier according to claim 2 wherein said tabs extend in a generally identical direction into said opening and terminate in said serrated free end edges respectively.

17. The carrier according to claim 16 wherein said tabs extend along the length of said medial partitioning structure to said serrated free end edges respectively.

* * * * *